US010315795B2

(12) United States Patent
Ehrmann

(10) Patent No.: US 10,315,795 B2
(45) Date of Patent: Jun. 11, 2019

(54) TEMPERATURE-CONDITIONED PACKAGING SYSTEM AND METHOD FOR SAME

(71) Applicant: MULTIVAC SEPP HAGGENMÜLLER GMBH & CO. KG, Wolfertschwenden (DE)

(72) Inventor: Elmar Ehrmann, Bad Grönenbach (DE)

(73) Assignee: Multivac Sepp Haggenmüller SE & Co. KG, Wolfertschwenden (DE)

( * ) Notice: Subject to any disclaimer, the term of this patent is extended or adjusted under 35 U.S.C. 154(b) by 563 days.

(21) Appl. No.: 14/698,387

(22) Filed: Apr. 28, 2015

(65) Prior Publication Data

US 2015/0314902 A1 Nov. 5, 2015

(30) Foreign Application Priority Data

May 5, 2014 (EP) ..... 14167033

(51) Int. Cl.

| | |
|---|---|
| ***B65B 65/00*** | (2006.01) |
| ***B65B 63/08*** | (2006.01) |
| ***B65B 51/10*** | (2006.01) |
| ***B65B 55/00*** | (2006.01) |

(52) U.S. Cl.

CPC ..... *B65B 63/08* (2013.01); *B65B 51/10* (2013.01); *B65B 55/00* (2013.01); *B65B 65/00* (2013.01)

(58) Field of Classification Search

CPC ..... B65B 63/08; B65B 51/10
USPC ..... 53/453, 127, 450
See application file for complete search history.

(56) References Cited

U.S. PATENT DOCUMENTS

| | | | | |
|---|---|---|---|---|
| 2,271,637 | A | 2/1942 | Garrison et al. | |
| 3,673,760 | A * | 7/1972 | Canamero | B65B 9/042 226/173 |
| 3,712,020 | A * | 1/1973 | Norr | B65B 11/52 53/127 |
| 4,294,859 | A * | 10/1981 | Lundquist | B65B 31/021 426/129 |
| 4,856,260 | A | 8/1989 | Woo et al. | |
| 4,909,016 | A | 3/1990 | Rentmeester et al. | |
| 5,505,813 | A | 4/1996 | Scheifele et al. | |
| 9,604,741 | B2 * | 3/2017 | Drechsler | B65B 35/24 |
| 2004/0139701 | A1 | 7/2004 | Cady et al. | |
| 2006/0254218 | A1 * | 11/2006 | Yamamoto | B32B 27/34 53/433 |

FOREIGN PATENT DOCUMENTS

| | | |
|---|---|---|
| FR | 1568475 A | 5/1969 |
| GB | 1262901 | 2/1972 |
| WO | 9609958 A1 | 4/1996 |

* cited by examiner

*Primary Examiner* — Chelsea E Stinson
(74) *Attorney, Agent, or Firm* — Husch Blackwell LLP

(57) ABSTRACT

The invention relates to a packaging system comprising a work station with a tool component, a loading station with a side panel component, and a thermal system conveying heatable fluid. The thermal system comprises cooling section and/or a heating section. The cooling section conveys the heatable fluid to the tool component and has an actuator configured for regulating the flow volume of the heatable fluid to the tool component. The heating section conveys the heatable fluid to the side panel component and is coupled at least in sections to the side panel component in order to heat the side panel component.

17 Claims, 7 Drawing Sheets

TEMPERATURE-CONDITIONED PACKAGING SYSTEM AND METHOD FOR SAME

CROSS-REFERENCE TO RELATED APPLICATIONS

This Application claims priority to European Patent Application Number 14167033.1 filed May 5, 2014, to Elmar Ehrmann, currently pending, the entire disclosure of which is incorporated herein by reference.

FIELD OF THE INVENTION

The invention relates to a packaging system and a method for temperature-conditioning a packaging system.

BACKGROUND OF THE INVENTION

It is known from practice that certain packaging machines, for example thermoforming packaging machines, are cooled during operation. Cooling may be performed during packaging whereby cooling fluid is conveyed to heatable tool components of the packaging machine (e.g., forming tools or sealing tools) in order to dissipate heat from them. For a thermoforming packaging machine this can aid the cooling-down process of the formed film. Such cooling can prevent tool components from heating up too much and posing a risk of injury to operating staff.

It has been found that it is important for uniform packaging quality to control the cooling process of the respective tool components of the thermoforming packaging machine such that an energy-level pre-set for the respective tool component remains constant during the packaging cycle, i.e., that the cooling capacity is controllable such that the tool components being cooled do not overheat or undercool.

It is furthermore true that packaging machines, in particular thermoforming packaging machines, for packaging food products are installed in a refrigerated surrounding, so that the food products to be packaged do not heat up too much during the packaging process, which would possibly cause the food products to spoil.

An efficiently cooled packing machine can therefore also ensure that the food products to be packaged are continuously exposed to a constant ambient temperature so that their cooling chain is not broken even during the packaging process.

Working in a continuously refrigerated environment, in particular in the region of a refrigerated packaging machine at for example 3-8° C., however, can lead to increased sickness times of the staff operating the packaging machine. Operators who are positioned for loading food products into pre-produced package trays along a loading stretch of a thermoforming packaging machine often fall sick much easier, most likely due to exposure to the cold.

SUMMARY OF THE INVENTION

The object of the present invention is to provide a packaging system in which improved temperature-conditioning of the packaging system is achieved with the simplest design measures. It is also the object of the invention to provide an improved method for temperature-conditioning a packaging system.

According to one embodiment of the present invention, the packaging system comprises a work station with a tool component, a loading station with a side panel component, and a thermal system conveying heatable fluid (e.g., water or oil), where the thermal system comprises a cooling section conveying the heatable fluid to the tool component and having an actuator which is configured for regulating the flow volume of the heatable fluid to the tool component, and/or where the thermal system comprises a heating section conveying the heatable fluid to the side panel component and being coupled at least in sections to the side panel component in order to heat it.

The packaging system according to one embodiment of the present invention has a thermal system which is advantageous in two respects over prior art initially discussed. The thermal system can, depending on the configuration, be advantageously used both for cooling as well as for heating the packaging system. The packaging process can be optimized by the packaging system of the invention and the working conditions of the operating staff can be improved.

In addition to the advantageous abilities of supporting the cooling-down process of the formed film, shortening the forming time, and increasing the capacity, the packaging system of the present invention can also efficiently couple the cooling of the tool component with the heating of the side panel component, so that the packaging system can from an energy perspective be used in a particularly environmentally-friendly and cost-efficient manner. In one embodiment, the packaging system uses the stored thermal energy, which is absorbed in the heatable fluid from cooling the tool component, directly for heating the side panel component, thereby eliminating the need for additional external sources of energy for heating the side panel component.

With the packaging system according to the present invention, a "healthier", more pleasant workplace can be created for the operating staff by heating the side panel component, because the staff is, during the loading process, no longer in contact with the cold side panel component. As a result, sicknesses, and thereby absence times from work due to sickness of staff, can be reduced.

Accordingly, one embodiment of the packaging system can cause optimum temperature-conditioning of the tool component in order to provide improved quality of production, as well as optimum temperature-conditioning of the side panel component of the loading stretch in order to heat the side panel component for comfort of the operating staff.

While coupling the cooling with the heating, as described above, can have significant advantages, the packaging system of the present invention can also be configured for only cooling the tool component or for only heating the side panel component. A packaging system provided only with the features for cooling the tool component can be employed particularly advantageously when a robot is positioned along the loading station for loading products into the package trays. A packaging system provided only with the features for heating the side panel component can be employed particularly advantageously when the tool component already experiences sufficient cooling by the environment or does not heat up much during the packaging process.

The heating section of the thermal system can comprise at least one thermal element for conveying the heatable fluid along an inner side of the side panel component. At this location, the thermal element is not visible from the outside so that the packaging system exhibits an improved overall appearance. The thermal element may be attached to the inner side of the panel component well such that it does not encumber the operating staff during the loading process. Furthermore, heat from the thermal element can from the inside be uniformly transferred to the side panel component. The operating staff is therefore no longer in contact with a cold side cover.

The thermal element can be integrally formed, for example, from cast aluminum or have an extruded profile, or be multi-part, for example, comprising an aluminum plate with a tube welded or bolted thereto. Several parallel tubes or a tube coil may be provided instead of a single straight tube.

In one embodiment of the present invention, the thermal element is integrally formed with the side panel component. This can enhance heat exchange between the thermal element and the side panel component because it is possible to eliminate additional connection elements therebetween. In addition, the side panel component is thereby configured to be very robust, which can result in reduced noise levels along the loading stretch.

The thermal element can be removably attached to the side panel component, in particular to the side panel component's inner side. This can be especially helpful when the thermal element must be removed from the packaging system for maintenance and service purposes. The thermal element can then also be retrofitted on the side panel component of the packaging system, whereby the packaging system is adaptable to different packaging locations and/or packaging conditions.

The thermal element may be adhesively bonded to the inner side of the side panel component, in particular using thermally conductive paste. This results in an easy attachment method, whereby heat can be well transferred via the thermally conductive paste to the side panel component.

In one embodiment, the thermal element comprises at least one support element. It can be used in particular as a device for attaching the thermal element to the side panel component. It would be conceivable to have the support element comprise attachment devices at its ends which are configured to primarily releaseably engage with the complementary attachment devices of the side panel component to hold the thermal element against the inner side of the side panel component.

The holding element may comprise an opening for clamping in a tube of the thermal element. Once the tube is clamped into the opening, the support element is aligned in a stable manner. The support element attached to the thermal element represents a spacer that pushes the thermal element under preload against the inner side of side panel component.

In a further embodiment of the present invention, the thermal element comprises a carrier plate with which the thermal element is arranged on the side panel component. The carrier plate may in particular provide a stable base with which the thermal element can be attached to the inner side of the side panel component. The carrier plate may form a large area which essentially covers the inner side of the side panel component so that the heat of the heatable fluid is via the carrier plate efficiently transferred to the side panel component.

The thermal element can comprise at least one tube arranged on the carrier plate for conveying the heatable fluid. The tube is a simple and compact way for conveying the heatable fluid and can be easily arranged along the inner side of the side panel component without impeding other components, such as a conveyor line of the packaging system.

The tube may be attached in a recess of the carrier plate, in particular welded into the recess in order to be disposed on the carrier plate in a particularly strong and stable manner. It would also be conceivable to have the tube be integrally formed into the carrier plate, i.e., combining two carrier plate halves with each other, where it can also be welded in between the carrier plate halves. This would be a particularly space-saving variant which would enhance the compactness of the loading station of the packaging system.

The tube could in an even easier manner be attached to the carrier plate if the thermal element has a receiving member comprising a strap and a seat, where the tube can be fastened onto the seat and the strap is welded to the carrier plate or between two halves of the carrier plate. The strap can connect the two carrier plate halves to each other at a predetermined angle to form the carrier plate in correspondence to the inner side of the side panel component.

It is particularly advantageous if the tube is made of aluminum because it is well suited to be used in an environment with the highest hygienic requirements and also has a relatively high thermal conductivity. In addition, the thermal element is thereby of lightweight and can be easily retrofitted on the side panel component.

According to another embodiment of the present invention, the thermal element comprises a plurality of tubes extending mutually parallel to each other and arranged on the carrier plate for conveying the heatable fluid. The heating rate for the side panel component can thereby be increased. In particular, the mounting options described above would be available for the respective tubes.

Alternatively, it is also be conceivable that the tube is designed as a tube coil which is fastened on the carrier plate and curls along the carrier plate so as to increase heat transfer to the carrier plate.

The tool component is preferably a forming tool lower part or upper part or a sealing tool lower part or upper part of a packaging machine, in particular a thermoforming packaging machine of the packaging system. It is thereby possible to maintain a desired operating temperature at the tool component which leads to a consistent quality-optimized and energy-efficient manufacturing result. By cooling the tool component, it can be ensured that the operating staff is not injured thereby, i.e.; that the cooled tool component also provides a contact safety function.

The packaging system can comprise at least one vacuum pump, in particular a vacuum pump for thermoforming package trays. In one embodiment, the cooling section also conveys the heatable fluid to the vacuum pump in order to cool it. This prevents overheating of the vacuum pump which is then well employable, in particular, also at high capacity increases or with production cycle changes. The vacuum pump is in particular located downstream of the (last) tool component to be cooled. Other work equipment, in addition to the tool component, can also be efficiently cooled by the thermal system.

According to a further variant, the thermal system comprises a delivery pump with variable conveying capacity which is configured to regulate the volume flow of the heatable fluid in the cooling section. It can in particular be used to accurately set a change of the volume flow in accordance with an intended cooling capacity.

It is particularly advantageous if the cooling section is in fluid communication with the heating section, where the heatable fluid heated by cooling the tool component can be conveyed from the cooling section into the heating section in order to therein be used for heating the side panel component. This enables the energy absorbed in the heatable fluid during the cooling process of the tool component to be used directly for heating of the side panel component, thus eliminating the need for additional sources of energy for heating the side panel component. From an energy perspective, the thermal energy stored in the system of the packaging system is therefore advantageously used for heating the side panel component. The thermal energy stored during the cooling process of the tool component is therefore not directly dissipated to the environment, which could lead to undesirable heating of the environment, but is used advantageously for directly heating the side panel component.

In one embodiment of the present invention, the actuator is a proportional valve for regulating the flow volume of the heatable fluid, wherein the thermal system comprises at least one temperature sensor which is adapted to detect a temperature of the heatable fluid heated by the tool component. The proportional valve allows accurate control of the volume flow of the heatable fluid to the tool component so that exact adaptation of the cooling capacity is adjustable for different temperature values detected. It is conceivable that an operator manually adjusts the volume flow on the proportional valve based on the temperature value detected.

The packaging system can comprise a control unit that is operably connected to the actuator and the temperature sensor and configured to control the actuator based on the temperature detected by the temperature sensor. The control unit can provide a central automated control function for regulating the cooling capacity, which in quick response appropriately controls the actuator for regulating the cooling capacity, in particular the proportional valve, based on the detected temperature value representing a value of the heat transferred to the heatable fluid by cooling the tool component. It is thereby achieved that the tool component can be maintained at a substantially constant operating temperature which leads to an optimum production result.

In order for the regulation of the actuator by use of the control unit not to become too frantic, the control unit can be configured to compare the detected temperature with a preset temperature range, and only then initiate a controlling operation of the actuator when the detected temperature is outside of the preset temperature range.

As an alternative to the proportional valve, the actuator can be designed as a conventional (water) faucet with which the operating staff of the packaging system can manually adjust a volume flow of the fluid to be heated. This variant is particularly inexpensive and can be used without additional control effort, where only a detected temperature of the heated heatable fluid must be monitored. Once the operating staff realizes, for example, that the detected temperature is above a predetermined target temperature value, then the faucet can be opened further so that the volume flow increases and thereby the cooling effect of the heatable fluid also increases. If, however, it is determined that the detected temperature of the heatable fluid is below the predetermined target temperature, then the volume flow can be throttled by use of the faucet to avoid unnecessarily high volume flow of the heatable fluid.

The invention also relates to a method for temperature-conditioning a packaging system. The packaging system may comprise a work station with at least one tool component, a loading station with at least one side panel component, and a thermal system conveying heatable fluid (e.g. water).

According to one embodiment of the method, the tool component is cooled by the heatable fluid in that the heatable fluid is conveyed through a cooling section of the thermal system to the tool component, where an actuator of the thermal system regulates the volume flow of the heatable fluid conveyed to the tool component and/or where the side panel component is heated by the heatable fluid in that it is conveyed through a heating section of the thermal system, at least in sections extending along the side panel component, to the side panel component to deliver heat to the latter.

The method according to one embodiment of the invention can therefore be used in particular for both cooling the tool component as well as for heating the side panel component, where it is also possible to provide only cooling for the tool component or only heating for the side panel component.

The heatable fluid heated by the tool component is preferably conveyed from the cooling section into the heating section of the thermal system in order to at least partially transfer energy, absorbed in the form of heat during the cooling process of the tool component, to the side panel component. This enables eliminating the need for additional sources of energy that are used for heating the side panel component. Such coupling between the cooling section and the heating section of the thermal system is particularly suited for the use in a thermoforming packaging machine in which a sufficient amount of heat can, during the forming and sealing process, be absorbed by the heatable fluid and can be efficiently used for heating the side panel component.

It is particularly advantageous if the heatable fluid is conveyed in a thermal element attached to an inner side of the side panel component. The thermal element used for conveying the heatable fluid may be adapted such that it is not visible from the outside and does not encumber the operating staff during the loading process at work.

For regulating the cooling of the tool component, a temperature sensor of the thermal system may detect a temperature of the heatable fluid heated by the tool component, where a control unit of the packaging system compares the detected temperature with a preset temperature value and based thereupon controls the actuator. This allows a closed control circuit to be provided which automatically controls the cooling capacity for the tool component.

Other and further objects of the invention, together with the features of novelty appurtenant thereto, will appear in the course of the following description.

DESCRIPTION OF THE SEVERAL VIEWS OF THE DRAWING

In the following, an advantageous embodiment of the invention is further illustrated using a drawing. Specifically.

DETAILED DESCRIPTION OF THE INVENTION

Figure 1:
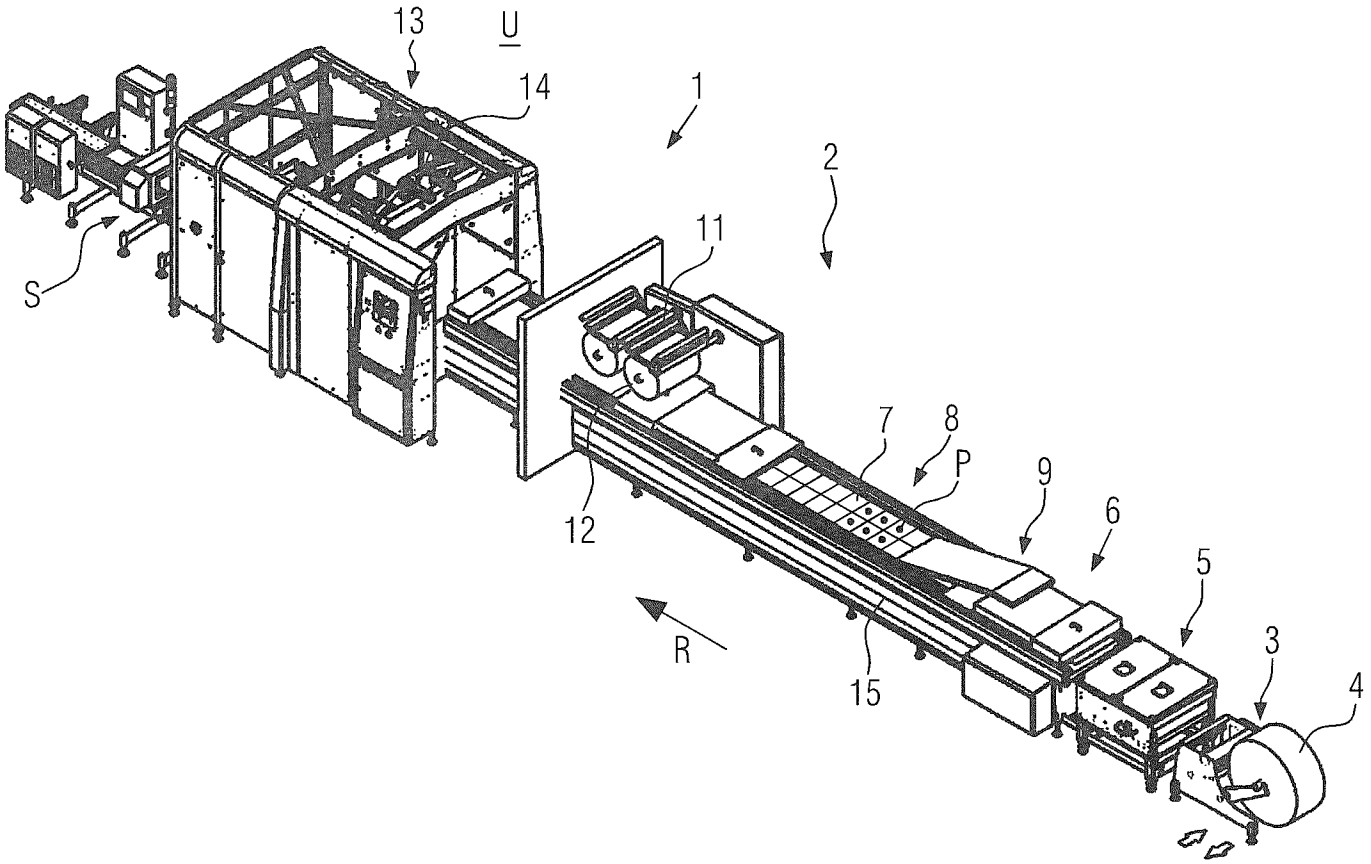
FIG. 1 is a side perspective view of a packaging system having a loading stretch in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a packaging system 1 with a work station 2 arranged in the direction of production R and configured as a thermoforming packaging machine. A film roll-off device 3 with a film 4 and a film stretching station 5 are upstream of the thermoforming packaging machine The thermoforming packaging machine may comprise a forming station 6 for producing package trays 7. The package trays 7 can be loaded with food products P along a loading station 8, either by a product feeder 9 or manually by operating staff.

The package trays 7 filled with food products P can be supplied to a sealing station 10 downstream of the loading station 8. The sealing station 10 of the thermoforming packaging machine is, by a top film roll-off device 11, supplied with a top film 12 which is welded onto the package trays 7 filled with food products P in order to enclose the food products P therein.

The packaging system in FIG. 1 can further comprise a separating station 13 with a robot 14 which transfers the individual filled and sealed package trays 7 to a downstream process, for example, a sorting belt S.

FIG. 1 further shows a side panel component 15 which is arranged along the loading station 8. The packaging system 1 is in particular installed in a refrigerated surrounding U so that the cooling chain of the frozen food products is not broken even during the packaging process. The respective work stations of the packaging system 1 therefore substantially assume the temperature of the surrounding U.

Prior to the present invention, the side panel component 15, which is in particular made of a metallic, long-shaped profile, substantially assumes a temperature value corresponding to that of the surrounding U, so that it usually cools down to temperatures below 10° C. This, however, has the drawback that operating staff who are working along the loading station 8 and possibly leaning against the side panel component 15 for placing the products P into the trays 7 are exposed to the cold, i.e., fall sick faster and are as a result absent due to sick leave.

Figure 2:
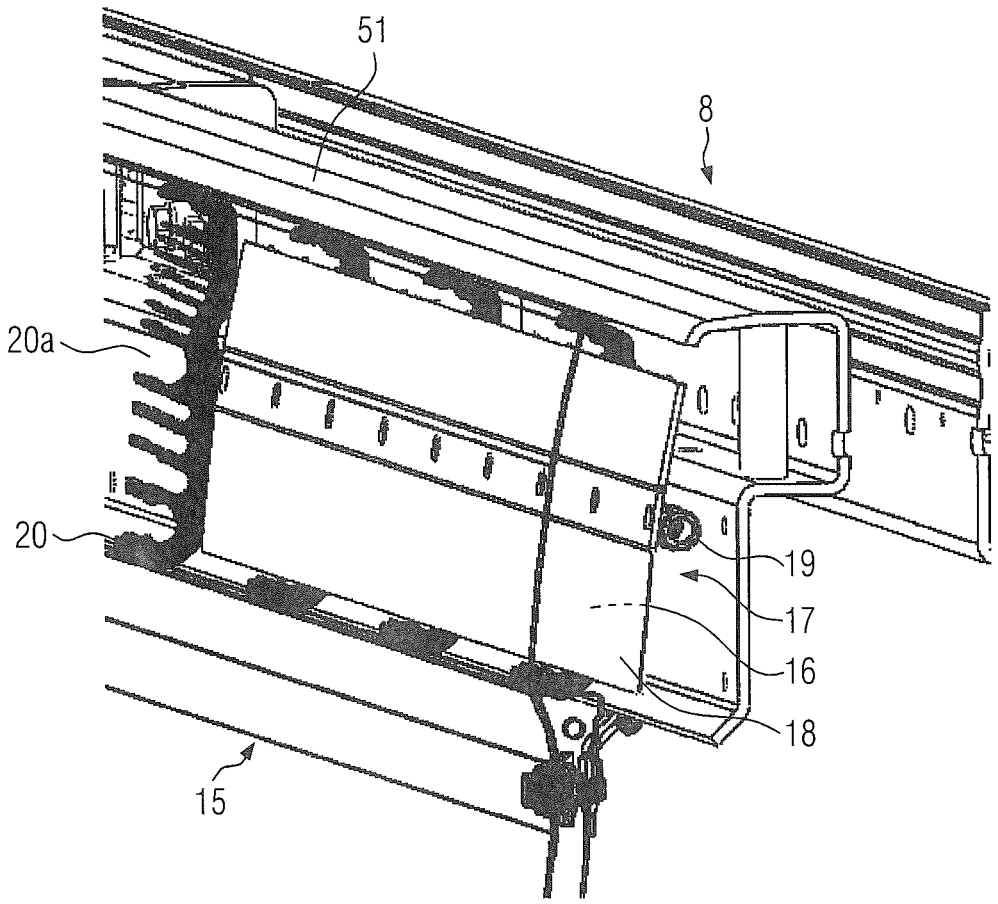
FIG. 2 is a perspective view of a thermal element attached along the inner side of a side panel component in accordance with one embodiment of the present invention.

FIG. 2 shows a perspective view of the side panel component 15 with a thermal element 17 disposed on an inner side 16 of the side panel component 15. The thermal element 17 may comprise a carrier plate 18 which is mounted flat on the inner side 16 of the side cover component 15. A tube 19 may be arranged on a side of the carrier plate 18 facing away from the inner side 16. The tube 19 is provided for conveying heatable fluid F (see FIG. 6), for example water, along the side panel component 15 and giving off heat to the side panel component 15.

FIG. 2 further shows a plurality of support elements 20 which are arranged along the side of the carrier plate 18 facing away from the inner side 16 above the tube 19. The support elements 20 can be clamped and aligned between a beam 51 of the loading station 8 and the side cover component 15 in order to hold the thermal element 17 against the inner side 16 of the side panel component 15. The support element 20 may further comprise an opening 20*a*. The opening 20*a* is formed such that the tube 19 of the thermal element 17 can be clamped thereinto (see FIG. 5) to preferably press the thermal element 17 under preload against the inner side 16.

Figure 3:
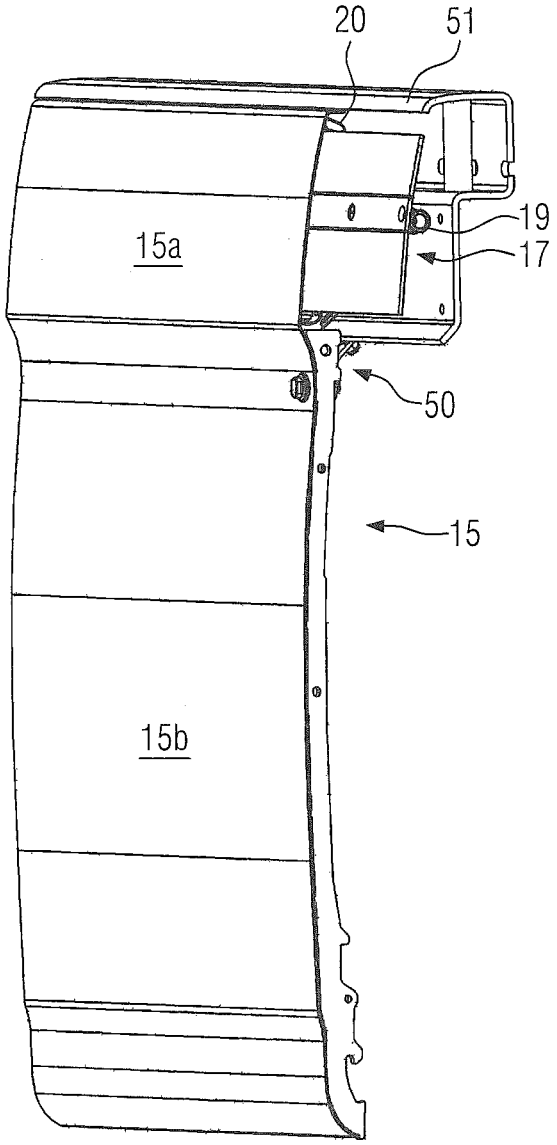
FIG. 3 is a further perspective view of the thermal element attached along the inner side of the side panel component in accordance with one embodiment of the present invention.

FIG. 3 shows a detail of the side panel component 15 of FIG. 2. The side panel component 15 has an upper thick portion 15*a* and a lower thin portion 15*b* which are integrally connected to each other. The thermal element 17 can be fixed at the upper thick portion 15*a* for heating the side panel component 15. A bolt connection 50 may be provided between the upper thick portion 15*a* and the lower thin portion 15*b* to secure the side panel component 15 to the beam 51 extending along the loading station 8.

Figure 4:
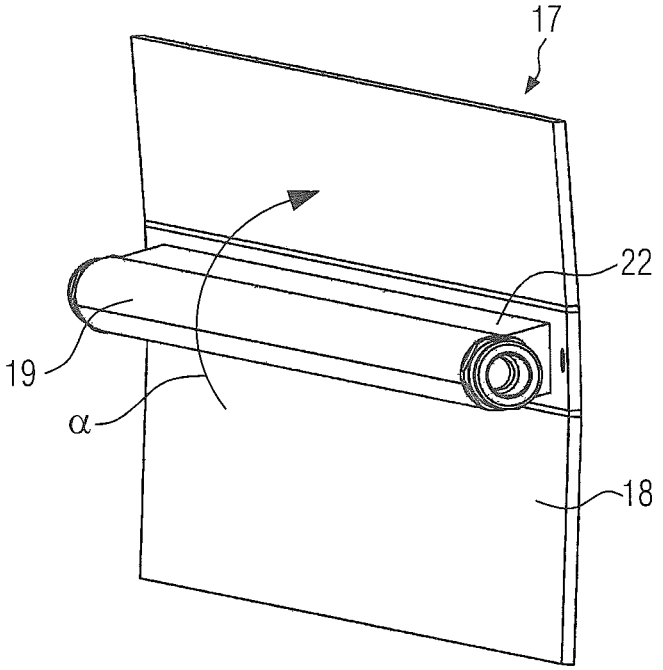
FIG. 4 is a perspective view of the thermal element with a carrier plate and a tube in accordance with one embodiment of the present invention.

FIG. 4 shows the thermal element 17 of the side panel component 15 from FIG. 3, now illustrated separately. The carrier plate 18 of the thermal element 17 may be integrally formed as an extruded profile. The carrier plate 18 can be formed at a predetermined angle a which corresponds substantially to an inclination of the inner side 16 of the side cover component 15 so that the carrier plate 18 can bear flat against the inner side 16. A heat-conducting element 22 is seated on the carrier plate 18 and has the tube 19 attached to it, for example, welded to it. The tube 19, however, can also be bolted directly onto the carrier plate 18 or welded to it.

Figure 5:
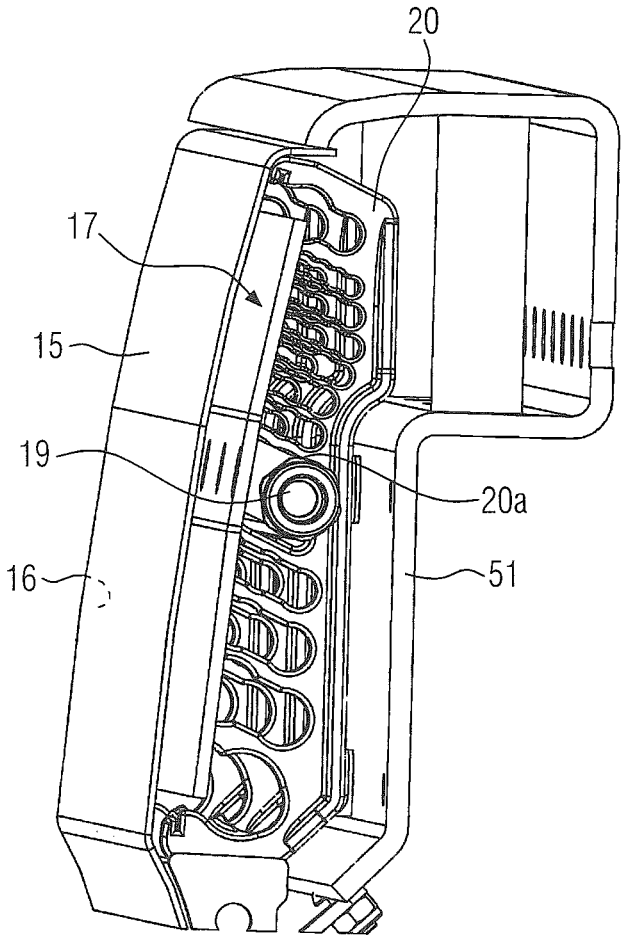
FIG. 5 is a perspective view of the thermal element with a support element in accordance with one embodiment of the present invention.

FIG. 5 shows a further perspective view of the side panel component 15. As is well visible, the support element 20 holds the thermal element 17 with the carrier plate 18 against the inner side 16 of the side panel component 15. The support element 20 can be configured such that it can be clamped between the beam 51 and the side panel component 15 so that it receives the thermal element 17 between itself and the inner side 16 and presses it against the inner side 16.

FIG. 5 further shows that the tube 19 of the thermal element 17 is clamped in the opening 20*a* of the support element 20 and that the support element 20 is clamped between the beam 51 and the side cover component 15 such that it presses the thermal element 17 under preload against the inner side 16. Consequently, the carrier plate 18 of the thermal element 17 bears flat against the inner side 16, whereby optimal heat transfer is ensured.

As an alternative to fastening by use of the support element 20, the thermal element 17 can be adhesively bonded to the inner side 16, for example, using thermally conductive paste.

Figure 6:
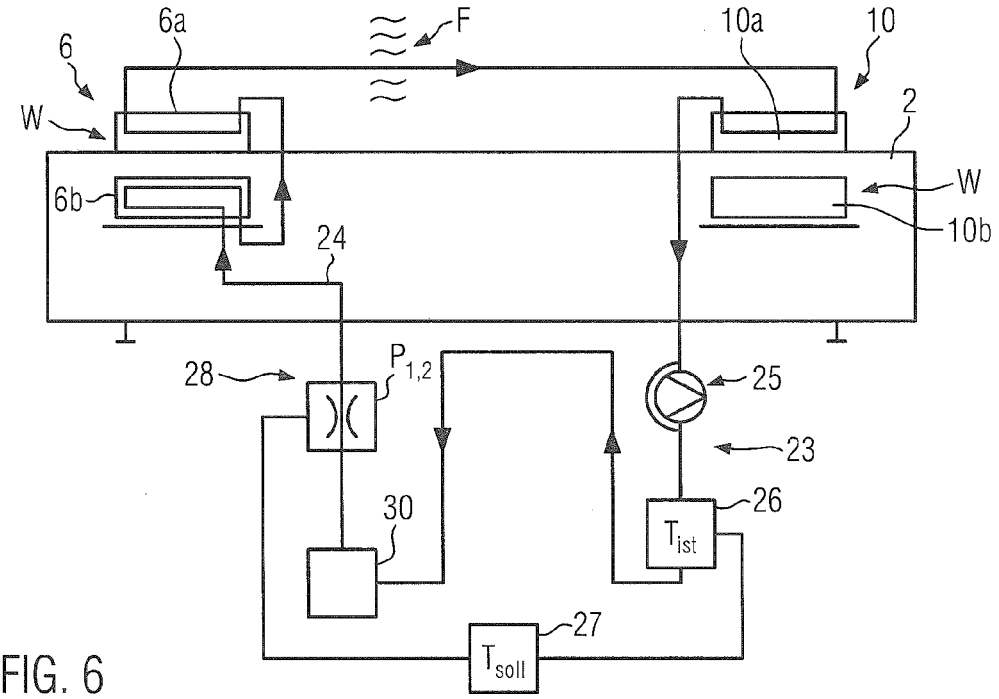
FIG. 6 is a schematic view of the cooling section for cooling the tool component in accordance with one embodiment of the present invention.

FIG. 6 schematically shows a thermal system 23 for temperature-conditioning the forming station 6 and the sealing station 10 of a thermoforming packaging machine. The forming station 6 and the sealing station 10 each comprise two tool components W, namely, a forming tool upper part and lower part 6*a*, 6*b* and a sealing tool upper part and lower part 10*a*, 10*b*. The thermal system 23 comprises a cooling section 24 in which the heatable fluid F is conveyed to the forming station 6 and to the sealing station 10 in order to cool them. According to FIG. 6, the cooling section 24 passes through the forming tool lower part 6*b* and the forming tool upper part 6*a* in order to cool them.

The cooling section 24 leads from the forming station 6 to the sealing station 10 into the sealing tool upper part 10*a*. The sealing tool lower part 10*b* could optionally likewise be cooled. The cooling section 24 leads from the sealing station 10 to an optional vacuum pump 25 of the thermoforming packaging machine 2 in order to cool it as well.

A temperature sensor 26 can be provided downstream of the optional vacuum pump 25 in the cooling section 24. The temperature sensor 26 may be configured to detect a temperature $T_{ist}$ of the fluid F heated by the upstream cooling process of the forming station 6, the sealing station 10 and the optional vacuum pump 25.

The temperature sensor 26 is operably connected to a control unit 27. The control unit 27 can be configured to regulate an actuator 28 integrated downstream in the cooling section 24 on the basis of the detected temperature $T_{ist}$ of the heatable fluid F in order to adjust a volume flow of the heatable fluid F in the cooling section 24 to the temperature value detected. The actuator 28 is, according to FIG. 6, configured as a proportional valve $P_1$ which is controllable by the control unit 27 to determine the volume flow of the heatable fluid F. The actuator 28 could alternatively also be a feed pump $P_2$ which is operably connected to the control unit 27 and the capacity of which can be regulated by the control unit 27 on the basis of the detected temperature value $T_{ist}$ of the heatable fluid F.

An optional cooling station 30 may be further provided within the cooling section 24 and configured to cool the heatable fluid to a predetermined temperature before it is conveyed on for cooling the forming station 6.

Figure 7:
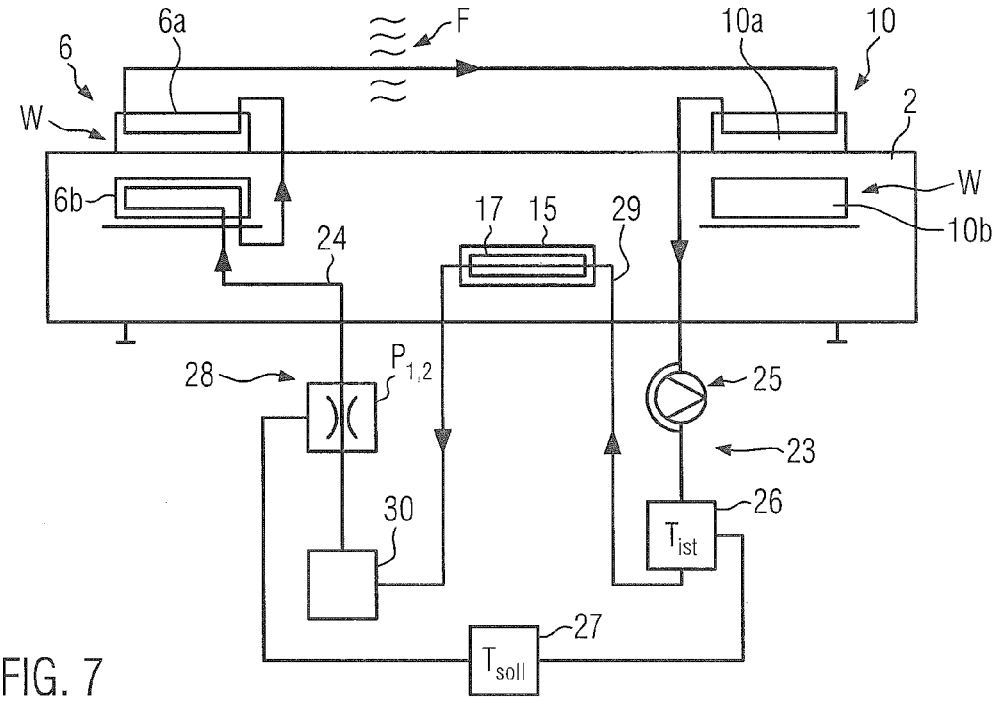
FIG. 7 is a schematic view of a coupling of the cooling section to a heating section of the thermal system in accordance with one embodiment of the present invention.

FIG. 7 substantially corresponds to FIG. 6, where a heating section 29, in which the thermal element 17 is connected, is connected in series with the cooling section 24. The heatable fluid F heated within the cooling section 24 therefore flows through the thermal element 17, thereby heating the side panel component 15 on the inner side 16 of which the thermal element 17 is attached. The heatable fluid F cools down due to the heat transfer to the thermal element 17 and is returned to the cooling section 24. The heatable fluid F can on its way back to the cooling section 24 optionally be additionally cooled to a desired temperature by the cooling station 30.

Figure 8:
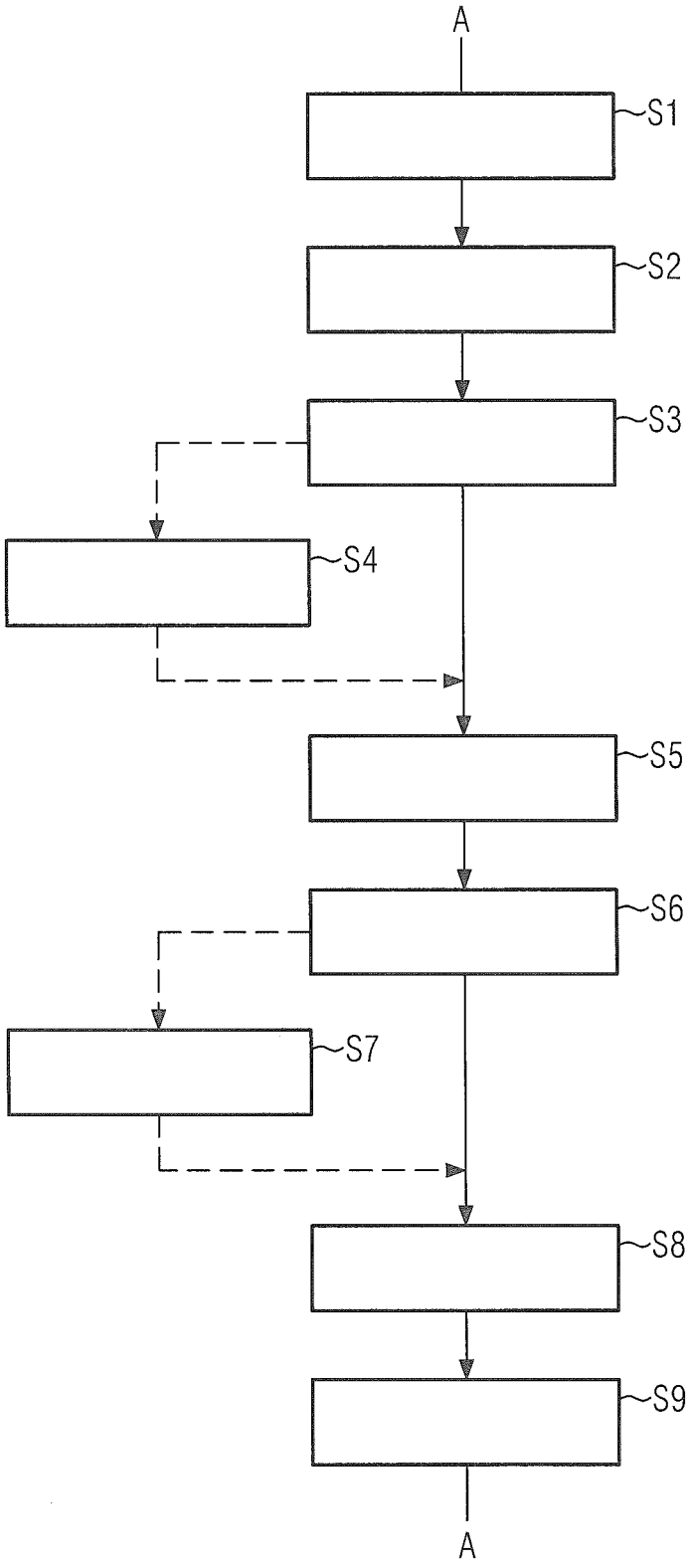
FIG. 8 is a schematic view of a method for temperature-conditioning a packaging system in accordance with one embodiment of the present invention.

A method for temperature-conditioning the packaging system 1 according to FIG. 8 could be performed as follows.

The heatable fluid F can be tap water and may have a temperature of 10 to 15° C. In step S1, the heatable fluid F may first pass through the forming tool lower part 6*b* to assist the cooling process of the formed film 4 and to shorten the time for thermoforming. Next, in step S2, the forming tool upper part 6*a* is cooled so that a prescribed safety/contact temperature of <50° C. is there not exceeded.

Then, in step S3, the sealing tool upper part 10*a* is cooled to also provide contact safety protection for the operating staff In step 4, the vacuum pump 25, which is optionally arranged in the cooling circuit of the thermoforming packaging machine, can likewise be cooled.

Downstream of the last tool component W or device (e.g., vacuum pump 25) to be cooled, the temperature sensor 26, in step S5, detects the temperature of the heated heatable fluid F. The control unit 27 operably integrated into the thermal system 23 then, in step S6, can regulate the volume flow of the heatable fluid F according to a target temperature $T_{soll}$ stored in the control unit 27 or a target temperature range stored in the control unit 27, respectively.

After detecting the temperature of the heatable fluid F in step S5, the heated heatable fluid F, which may be at about 30 to 40° C., is in optional step S7 conveyed into the heating section 29. From there, the heatable fluid F may be conveyed to the thermal element 17 of the thermal system 23 connected thereto. The heatable fluid F could after step S6 alternatively also further remain in the cooling section 24 (see also FIG. 6), for example, if it is in step S5 detected that the temperature of the heatable fluid F is too cold and not sufficient for heating the side cover component 15.

After heating the side panel component 15 in step S7, the heatable fluid F, now again being colder, is in step S8 conveyed into the cooling section 24 where it is further cooled down by the optional cooling station 30 in step S9 in order to then be supplied for cooling the forming station 6 and the sealing station 10.

The thermal system 23, which is according to one embodiment of the present invention configured for temperature-conditioning the packaging system 1, in particular a thermoforming packaging machine, could just as well be used with other packaging machines, for example, in a tray sealer, a tubular bag packaging machine or with a vacuum chamber machine.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A packaging system comprising:

a work station with a tool component, the tool component is comprised of at least one of a forming station for producing one or more package trays and a sealing station for welding a top film onto one or more package trays filled with food products;

a loading station comprising one or more produced packaging trays disposed to be loaded with food products, wherein said loading station comprises a side panel component disposed adjacent to said one or more produced packaging trays; and a thermal system for conveying heatable fluid, wherein said thermal system comprises a heating section for conveying said heatable fluid to said side panel component of said loading station and being coupled at least in sections to said side panel component in order to heat said side panel component.

2. The packaging system according to claim 1, wherein said heating section comprises at least one thermal element for conveying said heatable fluid along an inner side of said side panel component.

3. The packaging system according to claim 2, wherein said at least one thermal element is integrally formed with said side panel component.

4. The packaging system according to claim 2, wherein said at least one thermal element is removably attached to said side panel component.

5. The packaging system according to claim 2, wherein said at least one thermal element is configured as an extruded profile.

6. The packaging system according to claim 2, wherein said at least one thermal element comprises a carrier plate with which said at least one thermal element is arranged on said side panel component.

7. The packaging system according to claim 6, wherein said at least one thermal element comprises at least one tube for conveying said heatable fluid which is arranged on said carrier plate.

8. The packaging system according to claim 1, wherein said tool component is at least one of a forming tool lower part, a forming tool upper part, a sealing tool lower part, and a sealing tool upper part of the packaging system.

9. The packaging system according to claim 1, wherein said thermal system further comprises a cooling section disposed at said tool component, said thermal system operable to convey said heatable fluid to said tool component and having an actuator configured for regulating a flow volume of said heatable fluid to said tool component to cool said tool component, and said cooling section is in fluid communication with said heating section, and wherein said heatable fluid heated by cooling said tool component can be conveyed out from said cooling section into said heating section and used for heating said side panel component.

10. The packaging system according to claim 9, wherein said actuator is a proportional valve and said thermal system comprises at least one temperature sensor adapted to detect a temperature of said heatable fluid heated by said tool component.

11. The packaging system according to claim 10 further comprising a control unit that is operably connected to said actuator and said at least one temperature sensor and configured to control said actuator based on the temperature detected by said temperature sensor.

12. A method for temperature-conditioning a packaging system that includes a work station with a tool component, wherein the tool component is one of a forming station for producing package trays or a sealing station for welding a top film onto said plurality of package trays filled with food products; and a loading station with a side panel component, wherein a plurality of produced package trays are disposed at said loading station to be loaded with food products and said side panel component is adjacent to said plurality of produced package trays at said loading station, and a thermal system for conveying a heatable fluid, said method comprising the step of:

conveying said heatable fluid through a heating section of said thermal system to heat said side panel component at said loading station.

13. The method according to claim 12 wherein said method further comprises the step of:

conveying said heatable fluid through a cooling section of said thermal system to effectuate a cooling of said tool component by absorbing heat from said tool component, and regulating a volume flow of said heatable fluid conveyed to said tool component using an actuator of said thermal system; and conveying said heatable fluid heated by said tool component from said cooling section to said heating section of said thermal system in order to at least partially transfer energy absorbed in the form of heat during the cooling of said tool component to said side panel component.

14. The method according to claim 13 further comprising the steps of:

detecting a temperature of said heatable fluid heated by said tool component using a temperature sensor;

comparing said detected temperature with a preset temperature value using a control unit; and controlling said actuator with said control unit.

15. The method according to claim 12, wherein said heatable fluid is conveyed in a thermal element attached to an inner side of said side panel component.

16. A method for temperature-conditioning a packaging system, the method comprising:

providing a packaging machine having:

a work station with a tool component, the tool component being comprised of one of a forming station for producing package trays or a sealing station for welding a top film onto package trays filled with food products, and a loading station comprising one or more produced packaging trays disposed to be loaded with food products, wherein said loading station comprises a side panel component disposed adjacent to said one or more produced packaging trays at said loading station;

loading the one or more produced package trays with food products at the loading station; and conveying a heatable fluid through a heating section of a thermal system to heat said side panel component.

17. The method of claim 16 further comprising the step of: conveying the heatable fluid through a cooling section of said thermal system to cool said tool component, wherein an actuator of said thermal system regulates a volume flow of said heatable fluid conveyed to said tool component.

* * * * *